US007879221B2

(12) United States Patent
Pütter et al.

(10) Patent No.: US 7,879,221 B2
(45) Date of Patent: Feb. 1, 2011

(54) PROCESS FOR PREPARING POROUS METAL ORGANIC FRAMEWORKS

(75) Inventors: Hermann Pütter, Neustadt (DE); Markus Schubert, Ludwigshafen (DE); Ingo Richter, Schwetzingen (DE); Ulrich Müller, Neustadt (DE); Natalia Trukhan, Ludwigshafen (DE)

(73) Assignee: BASF SE, Ludwigshafen (DE)

( * ) Notice: Subject to any disclaimer, the term of this patent is extended or adjusted under 35 U.S.C. 154(b) by 219 days.

(21) Appl. No.: 12/300,902

(22) PCT Filed: May 11, 2007

(86) PCT No.: PCT/EP2007/054554

§ 371 (c)(1),
(2), (4) Date: Dec. 23, 2008

(87) PCT Pub. No.: WO2007/131948

PCT Pub. Date: Nov. 22, 2007

(65) Prior Publication Data

US 2009/0171107 A1 Jul. 2, 2009

(30) Foreign Application Priority Data

May 16, 2006 (EP) ..... 06114002

(51) Int. Cl.
*C25B 3/12* (2006.01)
*C07F 15/00* (2006.01)
*C07F 3/00* (2006.01)

(52) U.S. Cl. ..... 205/457; 556/1; 556/49; 556/55; 556/61; 556/114; 556/125; 556/136; 556/147; 556/183; 549/3; 549/211; 546/225; 534/16

(58) Field of Classification Search ..... 556/1, 556/49, 55, 61, 114, 125, 136, 147, 183; 549/3, 211; 546/225; 534/16; 205/457
See application file for complete search history.

(56) References Cited

U.S. PATENT DOCUMENTS 3,964,983 A 6/1976 Eisenbach et al.
5,648,508 A 7/1997 Yaghi
2007/0227898 A1* 10/2007 Muller et al. ..... 205/457
2008/0214806 A1 9/2008 Schubert et al.
2009/0183996 A1* 7/2009 Richter et al. ..... 205/424

FOREIGN PATENT DOCUMENTS

DE 10 2005 023 856 5/2005
WO WO-02088148 11/2002
WO WO-2005/049892 6/2005
WO WO-2006/125761 11/2006

OTHER PUBLICATIONS

Eddaoudi et al., "Systematic Design of Pore Size and Functionality in Isoreticular MOFs and Their Application in Methane Storage," Science, vol. 295 (Jan. 18, 2002, pp. 469-472).
Chen et al., "Interwoven Metal-Organic Framework on a Periodic Minimal Surface with Extra-Large Pores," Science vol. 291 (Feb. 9, 2001), pp. 1021-1023.
Seki et al., "Syntheses and Characterization of Microporous Coordination Polymers with Open Frameworks," J. Phys. Chem. B 2002, 106, pp. 1380-1385.
S. Kitagawa et al., "Functional Porous Coordination Polymers," Angew. Chem. Int. Ed. 43 (2004), pp. 2334-2375.
International Preliminary Report on Patentability isused Jan. 13, 2009 in corresponding International Application No. PCT/EP2007/054554, along with the English language translation.

* cited by examiner

*Primary Examiner*—Porfirio Nazario Gonzalez
(74) *Attorney, Agent, or Firm*—Connolly Bove Lodge & Hutz LLP

(57) ABSTRACT

The present invention relates to a process for preparing a porous metal organic framework comprising at least two organic compounds coordinated to at least one metal ion, which comprises the steps (a) oxidation of at least one anode comprising the metal corresponding to at least one metal ion in a reaction medium in the presence of at least one first organic compound which is an optionally substituted monocyclic, bicyclic or polycyclic saturated or unsaturated hydrocarbon in which at least two ring carbons have been replaced by heteroatoms selected from the group consisting of N, O and S to form a reaction intermediate comprising the at least one metal ion and the first organic compound; and (b) reaction of the reaction intermediate at a prescribed temperature with at least one second organic compound which coordinates to the at least one metal ion, with the second organic compound being derived from a dicarboxylic, tricarboxylic or tetracarboxylic acid.

10 Claims, No Drawings

PROCESS FOR PREPARING POROUS METAL ORGANIC FRAMEWORKS

CROSS REFERENCE TO RELATED APPLICATIONS

This application is a 35 U.S.C. 371 National Stage Application of International Application No. PCT/EP2007/054554, filed May 11, 2007, claiming priority from European Application No. 06114002.6, filed May 16, 2006, the entire contents of which are incorporated herein by reference in their entireties.

The present invention relates to a process for preparing a porous metal organic framework comprising at least two organic compounds coordinated to at least one metal ion.

Crystalline porous metal organic frameworks (MOFs=metal organic frameworks) having particular pores or pore distributions and large specific surface areas have in recent times become the object of comprehensive research work.

Thus, for example, U.S. Pat. No. 5,648,508 describes microporous metal organic materials which are prepared under mild reaction conditions from a metal ion and a ligand in the presence of a template compound.

WO-A 02/088148 discloses the preparation of a series of compounds which have the same framework topology. These IRMOF (isoreticular metal organic framework) structures are monocrystalline and mesoporous frameworks which have a very high storage capacity for gases.

Eddaoudi et al., Science 295 (2002), 469-472, describe, for example, the preparation of an MOF-5 from a zinc salt, i.e. zinc nitrate. For the synthesis of the MOF, this salt and 1,4-benzenedicarboxylic acid (BDC) are dissolved in N,N-diethylformamide (DEF).

Chen et al., Science 291 (2001), 1021-1023, describe, for example, the preparation of an MOF-14, in which a copper salt (copper nitrate) is used as starting material and this salt and 4,4',4"-benzene-1,3,5-triyltribenzoic acid ($H_3BTC$) are dissolved in N,N-dimethylformamide (DMF) and water to synthesize the MOF.

To improve the properties of metal organic frameworks prepared in this way, Seki et al., J. Phys. Chem. B 2002, 106, 1380-1385, have reacted metal organic frameworks prepared in a conventional way with triethyldiamine in a heterogeneous reaction. Here, the results presented are said to lead to the development of porous materials in which it is necessary to control the structure for applications such as gas storage, separation, catalysis and molecular recognition.

Similar structures have been described by S. Kitagawa et al., Angew. Chem. Int. Ed. 43 (2004), 2334-2375.

An improved process for preparing porous metal organic frameworks which have at least two coordinated organic compounds is described in DE-A 10 2005 023 856. Here, a metal ion is made available by means of electrochemical oxidation in a single-stage reaction in a reaction medium which further comprises the two organic compounds. Furthermore, an alternative process which comprises two reaction steps is described. The oxidation to generate a metal ion is carried out in a first step in the presence of a first compound which has at least two carboxylate groups and the intermediate complex formed is subsequently reacted with a second organic compound.

Despite this improved method of preparation using the electrochemical generation of the metal ion, there is a need for further optimized methods of preparation.

It is therefore an object of the present invention to provide a process which allows an improved preparation of a porous metal organic framework having at least two organic compounds. In particular, a very inexpensive process which can readily be scaled up should be provided.

The object is achieved by a process for preparing a porous metal organic framework comprising at least two organic compounds coordinated to at least one metal ion, which comprises the steps:

(a) oxidation of at least one anode comprising the metal corresponding to at least one metal ion in a reaction medium in the presence of at least one first organic compound which is an optionally substituted monocyclic, bicyclic or polycyclic saturated or unsaturated hydrocarbon in which at least two ring carbons have been replaced by heteroatoms selected from the group consisting of N, O and S to form a reaction intermediate comprising the at least one metal ion and the first organic compound; and (b) reaction of the reaction intermediate at a prescribed temperature with at least one second organic compound which coordinates to the at least one metal ion, with the second organic compound being derived from a dicarboxylic, tricarboxylic or tetracarboxylic acid.

It has been found that it is advantageous, in contrast to the two-stage procedure from DE-A 10 2005 023 856, firstly to add not the polybasic carboxylic acid but instead the further organic compound to the reaction medium during the anodic oxidation of the metal and only to carry out the reaction with the polybasic carboxylic acid in a second step, since the carboxylic acid essentially determines the framework structure of the porous metal organic framework.

In this way, the formation of the actual framework is decoupled from the anodic oxidation and can therefore be carried out using a simpler synthesis apparatus for a longer time. As a result, the oxidation in step (a) can be limited to a minimum reaction time, which is advantageous for the electrochemical oxidation because of the comparatively high cost of apparatus.

The process of the invention also makes it possible to use polybasic carboxylic acids which do not withstand the conditions of the electrochemical oxidation. In addition, the reaction intermediate makes it possible to prepare, in a simple manner, a large number of porous metal organic frameworks in which the polybasic carboxylic acid is varied in the simpler second step.

Step (a) of the process of the invention is the anodic oxidation of the at least one metal which enters the reaction medium as cation and reacts with a first organic compound to form a reaction intermediate. This reaction intermediate can, for example, be separated off by filtration and then reacted further with the second organic compound. However, the reaction intermediate is preferably used without further work-up in step (b) of the process of the invention. The reaction intermediate is typically present in a suspension. The reaction intermediate can be a salt and/or a porous metal organic framework and/or a nonporous metal organic framework. The salt can be formed by reaction of the solvent or one of its constituents (for example as alkoxide when a solvent comprising at least one alcohol is used). Here, it has surprisingly been found that the presence of the first organic compound contributes to a better or more controlled dissolution of the anode.

Step (a) of the process of the invention can preferably be carried out as described in WO-A 2005/049812.

The term "electrochemical preparation" as used in the context of the present invention refers to a method of preparation in which, in at least one process step, the formation of at least one reaction product is associated with the migration of electric charges or the appearance of electric potentials.

The term "at least one metal ion" as used in the context of the present invention refers to embodiments in which at least one ion of a metal or at least one ion of a first metal and at least one ion of at least one second metal which is different from the first metal is/are provided by anodic oxidation.

The present invention also comprises embodiments in which at least one ion of at least one metal is provided by anodic oxidation and at least one ion of at least one metal is provided via a metal salt, with the at least one metal in the metal salt and the at least one metal which is provided as metal ion by means of anodic oxidation can be identical or different. The present invention therefore comprises, for example, an embodiment in which the reaction medium comprises one or more different salts of a metal and the metal ion comprised in this salt or these salts is additionally provided by anodic oxidation of at least one anode comprising this metal. The present invention likewise comprises an embodiment in which the reaction medium comprises one or more different salts of at least one metal and at least one metal which is different from these metals is provided as metal ion in the reaction medium by anodic oxidation.

In a preferred embodiment of the present invention, the at least one metal ion is provided by anodic oxidation of at least one anode comprising this at least one metal with no further metal being provided via a metal salt.

The present invention accordingly comprises an embodiment in which the at least one anode comprises a single metal or two or more metals. If the anode comprises a single metal, this metal is provided by anodic oxidation, and if the anode comprises two or more metals, at least one of these metals is provided by anodic oxidation.

Furthermore, the present invention comprises an embodiment in which at least two anodes which may be identical or different are used. Each of the at least two anodes can comprise a single metal or two or more metals. It is possible, for example, for two different anodes to comprise the same metals but in different proportions. It is likewise possible in the case of different anodes for, for example, a first anode to comprise a first metal and a second anode to comprise a second metal, with the first anode not comprising the second metal and/or the second anode not comprising the first metal.

The metal or metals are elements of groups 2 to 15 of the Periodic Table of the Elements. For the purposes of the present invention, preferred metal ions are selected from the group of metals consisting of copper, iron, aluminum, zinc, magnesium, zirconium, titanium, vanadium, molybdenum, tungsten, indium, calcium, strontium, cobalt, nickel, platinum, rhodium, ruthenium, palladium, scandium, yttrium, a lanthanide, manganese and rhenium. Greater preference is given to iron, copper, zinc, nickel and cobalt. Particular preference is given to copper.

As metal ions which are provided in the reaction medium by anodic oxidation, mention may be made of, in particular $Cu^{2+}$, $Cu^{+}$, $Ni^{2+}$, $Ni^{+}$, $Fe^{3+}$, $Fe^{2+}$, $Co^{3+}$, $Co^{2+}$, $Zn^{2+}$, $Mn^{3+}$, $Mn^{2+}$, $Al^{3+}$, $Mg^{2+}$, $Sc^{3+}$, $Y^{3+}$, $Ln^{3+}$, $Re^{3+}$, $V^{3+}$, $In^{3+}$, $Ca^{2+}$, $Sr^{2+}$, $Pt^{2+}$, $TiO^{2+}$, $Ti^{4+}$, $ZrO^{2+}$, $Zr^{4+}$, $Ru^{3+}$, $Ru^{2+}$, $Mo^{3+}$, $W^{3+}$, $Rh^{2+}$, $Rh^{+}$, $Pd^{2+}$ and $Pd^{+}$. Particular preference is given to $Zn^{2+}$, $Cu^{2+}$, $Cu^{+}$, $Fe^{2+}$, $Fe^{3+}$, $Ni^{2+}$, $Ni^{+}$, $Co^{3+}$ and $Co^{2+}$. Very particular preference is given to $Cu^{2+}$ and $Cu^{+}$.

The present invention therefore also describes, for step a), a process as described above in which a copper- and/or a nickel- and/or a cobalt- and/or a zinc- and/or an iron-comprising anode is used as metal ion source.

In a preferred embodiment, the present invention also provides a process as described above in which a copper-comprising anode is used as metal ion source.

The anode used in step a) of the process of the invention can in principle have any desired structure, as long as it is ensured that the at least one metal ion can be provided in the reaction medium by means of anodic oxidation in order to form the reaction intermediate.

Preference is given, inter alia, to anodes in the form of a rod and/or a ring and/or a disk such as an annular disk and/or a plate and/or a tube and/or a bed and/or a cylinder and/or a cone and/or a frustum of a cone.

In a preferred embodiment, the process of the invention is carried out using at least one sacrificial anode in step a). The term "sacrificial anode" as used in the context of the present invention refers to an anode which at least partly dissolves during the course of the process of the invention. Embodiments in which at least part of the dissolved anode material is replaced during the course of the process are also comprised. This can be achieved, for example, by at least one fresh anode being introduced into the reaction system or, in a preferred embodiment, an anode being introduced into the reaction system and fed further into the reaction system either continuously or discontinuously during the course of the process of the invention.

Preference is given, in the process of the invention, to using anodes which consist of the at least one metal serving as metal ion source or comprise this at least one metal applied to at least one suitable support material.

The geometry of the at least one support material is subject to essentially no restrictions. It is possible, for example, to use support materials in the form of a woven fabric and/or a foil and/or a felt and/or a mesh and/or rod and/or a candle and/or a cone and/or a frustum of a cone and/or a ring and/or a disk and/or a plate and/or a tube and/or a bed and/or a cylinder.

Support materials which can be used according to the invention are, for example, metals such as at least one of the abovementioned metals, alloys such as steels or bronzes or brass, graphite, felt or foams.

Very particular preference is given to anodes which consist of the at least one metal serving as metal ion source.

The cathode used in step a) of the process of the invention can in principle have any desired structure, as long as it is ensured that the at least one metal ion can be provided in the reaction medium by means of anodic oxidation.

In a preferred embodiment of the process of the invention, the electrically conductive electrode material of the at least one cathode is selected so that no interfering secondary reaction takes place in the reaction medium. As preferred cathode materials, mention may be made of, inter alia, graphite, copper, zinc, tin, manganese, silver, gold, platinum or alloys such as steels, bronzes or brass.

As preferred combinations of the anode material serving as metal ion source and the electrically conductive cathode material, mention may be made of, for example:

| Anode | Cathode |
|---|---|
| Zinc | Zinc |
| Copper | Copper |
| Magnesium | Copper |
| Cobalt | Cobalt |
| Iron | Steel |
| Copper | Steel |

The geometry of the at least one cathode is subject to essentially no restrictions. It is possible, for example, to use cathodes in the form of a rod and/or a ring and/or a disk and/or a plate and/or a tube.

For the purposes of the present invention, it is essentially possible to use any types of cells which are customary in electrochemistry. In the process of the invention, very particular preference is given to an electrolysis cell which is suitable for the use of sacrificial electrodes.

It is in principle possible, inter alia, to use divided cells having, for example, a parallel arrangement of electrodes or candle-shaped electrodes. As dividing medium between the cell compartments, it is possible to use, for example, ion-exchange membranes, microporous membranes, diaphragms, filter fabrics made of materials which do not conduct electrons, glass frits and/or porous ceramics. Preference is given to using ion-exchange membranes, in particular cation-exchange membranes, among which preference is in turn given to membranes which comprise a copolymer of tetrafluoroethylene and a perfluorinated monomer comprising sulfonic acid groups.

In a preferred embodiment-of the process of the invention, one or more undivided cells are preferably used in step a).

The present invention therefore also provides a process as described above which is carried out in an undivided electrolysis cell.

Very particular preference is given to combinations of geometries of anode and cathode in which the sides of the anode and cathode which face one another together form a gap of homogeneous thickness.

In the at least one undivided cell, the electrodes are, for example, preferably arranged in parallel, with the electrode gap having a homogeneous thickness in the range, for example, from 0.5 mm to 30 mm, preferably in the range from 0.75 mm to 20 mm and particularly preferably in the range from 1 to 10 mm.

In a preferred embodiment, it is possible, for example, to arrange a cathode and an anode in parallel in such a way that an electrode gap having a homogeneous thickness in the range from 0.5 to 30 mm, preferably in the range from 1 to 20 mm, more preferably in the range from 5 to 15 mm and particularly preferably in the range from 8 to 12 mm, for example in the region of about 10 mm, is formed in the resulting cell. This type of cell is, in the context of the present invention, referred to as a "gap cell".

In a preferred embodiment of the process of the invention, the above-described cell is used as a bipolar cell.

Apart from the above-described cell, the electrodes are, in a likewise preferred embodiment of the process of the invention, employed individually or as a stack of a plurality of them. In the latter case, these are stacked electrodes which, in the corresponding stacked plate cell, are preferably arranged in series with a bipolar connection. For the implementation of step a) of the process of the invention on an industrial scale, in particular, preference is given to using at least one pot cell and particularly preferably stacked plate cells connected in series whose in-principle structure is described in DE 195 33 773 A1.

In the preferred embodiment of the stacked plate cell, preference is given, for example, to disks of suitable materials, for example copper disks, being arranged in parallel so that a gap having a homogeneous thickness in the range from 0.5 to 30 mm, preferably in the range from 0.6 to 20 mm, more preferably in the range from 0.7 to 10 mm, more preferably in the range from 0.8 to 5 mm and in particular in the range from 0.9 to 2 mm, for example in the region of about 1 mm, is formed in each case between the individual disks. The spacings between the individual disks can be identical or different, with the spacings between the disks being essentially identical in a particularly preferred embodiment. In a further embodiment, the material of a disk of the stacked plate cell can differ from the material of another disk of the stacked plate cell. For example, one disk can be made of graphite and another disk can be made of copper, with the copper disk preferably being connected as anode and the graphite disk preferably being connected as cathode.

Furthermore, preference is given for the purposes of the present invention to using, for example, "pencil sharpener" cells as are described, for example, in J. Chaussard et al., J. Appl. Electrochem. 19 (1989) 345-348, whose relevant contents are fully incorporated by reference into the present patent application. Particular preference is given to using pencil sharpener cells having rod-shaped electrodes which can be fed in further in the process of the invention.

In particular, the present invention therefore also provides, for step a), a process as described above which is carried out in a gap cell or stacked plate cell.

Cells in which the electrode spacing is less than or equal to 1 mm are referred to as capillary gap cells.

In likewise preferred embodiments of the process of the invention, electrolysis cells having, for example, porous electrodes comprising beds of metal particles or having, for example, porous electrodes composed of metal meshes or having, for example, electrodes comprising both beds of metal particles and metal meshes can be used in step a).

In a further preferred embodiment, electrolysis cells which have at least one sacrificial anode having a circular cross section and at least one cathode having an annular cross section are used in the process of the invention, with particular preference being given to the diameter of the preferably cylindrical anode being smaller than the internal diameter of the cathode and the anode being arranged in the cathode so that a gap of homogeneous thickness is formed between the outer surface of the cylindrical wall of the anode and the internal surface of the cathode which at least partly surrounds the anode.

For the purposes of the present invention, it is also possible to reverse the polarity so that the original anode becomes the cathode and the original cathode becomes the anode. In this process variant, it is possible, for example, firstly to make one metal available as metal cation by means of anodic oxidation and, in a second step, to make a further metal available after reversal of the polarity when electrodes comprising different metals are selected appropriately. It is likewise possible to bring about the reversal of the polarity by use of alternating current.

It is in principle possible to carry out the process batchwise or continuously or in mixed operation. The process is preferably carried out continuously in at least one flow cell.

The voltages employed in the process of the invention can be matched to the respective at least one metal of the at least one anode serving as metal ion source for the reaction intermediate and/or to the properties of the first organic compound and/or, if appropriate, to the properties of the at least one solvent described below and/or, if appropriate, to the properties of the at least one electrolyte salt described below and/or to the properties of the at least one cathodic depolarization compound described below.

In general, the voltages per electrode pair are in the range from 0.5 to 100 V, preferably in the range from 2 to 40 V and particularly preferably in the range from 4 to 20 V. Examples of preferred ranges are from about 4 to 10 V or from 10 to 20 V or from 20 to 25 V or from 10 to 25 V or from 4 to 20 V or from 4 to 25 V. Here, the voltage can be constant during the course of the process of the invention or can change continuously or discontinuously during the course of the process.

When, for example, copper is anodically oxidized, the voltages are generally in the range from 3 to 20 V, preferably in the range from 3.5 to 15 V and particularly preferably in the range from 4 to 15 V.

The current densities which occur in the preparation according to the invention of the porous organic frameworks are generally in the range from 0.01 to 1000 mA/cm$^2$, preferably in the range from 0.1 to 1000 mA/cm$^2$, more preferably in the range from 0.2 to 200 mA/cm$^2$, more preferably in the range from 0.3 to 100 mA/cm$^2$ and particularly preferably in the range from 0.5 to 50 mA/cm$^2$.

The process of the invention is generally carried out at a temperature in the range from 0° C. to the boiling point, preferably in the range from 20° C. to the boiling point, of the respective reaction medium or the at least one solvent used, preferably under atmospheric pressure. It is likewise possible to carry out the process under superatmospheric pressure, with pressure and temperature preferably being selected so that the reaction medium is preferably at least partly liquid.

In general, the process of the invention is carried out at a pressure in the range from 0.5 to 50 bar, preferably in the range from 1 to 6 bar and particularly preferably at atmospheric pressure.

Depending on the type and state of matter of the constituents of the reaction medium, the electrochemical preparation according to the invention of the reaction intermediate in step a) can in principle also be carried out without an additional solvent. This is, for example, the case when, in particular, the first organic compound functions as solvent in the reaction medium.

It is in principle likewise possible to carry out the process of the invention without use of a solvent, for example in the melt, in which case at least one constituent of the reaction medium is present in the molten state.

In a preferred embodiment of the present invention, the reaction medium comprises at least one suitable solvent in addition to the first organic compound and, if appropriate, to the at least one electrolyte salt and, if appropriate, to the at least one cathodic depolarization compound. The chemical nature and the amount of this at least one solvent can be matched to the first organic compound and/or to the at least one electrolyte salt and/or to the at least one cathodic depolarization compound and/or to the at least one metal ion.

Conceivable solvents are in principle all solvents or all solvent mixtures in which the starting materials used in step a) of the process of the invention can be at least partly dissolved or suspended under the selected reaction conditions such as pressure and temperature. Examples of solvents which can be used are, inter alia,

- water;
- alcohols having 1, 2, 3 or 4 carbon atoms, e.g. methanol, ethanol, n-propanol, isopropanol, n-butanol, isobutanol, tert-butanol;
- carboxylic acids having 1, 2, 3 or 4 carbon atoms, e.g. formic acid, acetic acid, propionic acid or butanoic acid;
- nitriles such as acetonitrile or cyanobenzene;
- ketones such as acetone;
- at least singly halogen-substituted lower alkanes such as methylene chloride or 1,2-dichloroethane;
- acid amides such as amides of lower carboxylic acids, for example carboxylic acids having 1, 2, 3 or 4 carbon atoms, e.g. amides of formic acid, acetic acid, propionic acid or butanoic acid, for example formamide, dimethylformamide (DMF), diethylformamide (DEF), t-butylformamide, acetamide, dimethylacetamide, diethylacetamide or t-butylacetamide;
- cyclic ethers such as tetrahydrofuran or dioxane;
- N-formyl amides or N-acetyl amides or symmetrical or unsymmetrical urea derivatives of primary, secondary or cyclic amines such as ethylamine, diethylamine, piperidine or morpholine;
- amines such as ethanolamine, triethylamine or ethylenediamine;
- dimethyl sulfoxide;
- pyridine;
- trialkyl phosphites and phosphates;

or mixtures of two or more of the abovementioned compounds.

Preference is given to organic solvents, in particular alcohols.

The term "solvents" as used above encompasses both pure solvents and solvents which comprise small amounts of at least one further compound, for example preferably water. In this case, the water contents of the abovementioned solvents are in the range up to 1% by weight, preferably in the range up to 0.5% by weight, particularly preferably in the range from 0.01 to 0.5% by weight and particularly preferably in the range from 0.1 to 0.5% by weight. For the purposes of the present invention, the term "methanol" or "ethanol" or "acetonitrile" or "DMF" or "DEF" encompasses, for example, a solvent which can comprise the in each case particularly preferred water in an amount of from 0.1 to 0.5% by weight.

Solvents which are preferably used in step a) of the process of the invention are methanol, ethanol, acetonitrile, DMF and DEF and mixtures of two or more of these compounds. Very particularly preferred solvents are methanol, ethanol DMF, DEF and mixtures of two or more of these compounds. Methanol is especially preferred.

In a preferred embodiment, at least one protic solvent is used as solvent. This is preferably used when, inter alia, cathodic formation of hydrogen is to be achieved in order to avoid the redeposition described below on the cathode of the at least one metal ion provided by anodic oxidation.

When, for example, methanol is used as solvent, the temperature in step a) of the process of the invention under atmospheric pressure is generally in the range from 0 to 90° C.; preferably in the range from 0 to 65° C. and particularly preferably in the range from 25 to 65° C.

When, for example, ethanol is used as solvent, the temperature in the process of the invention under atmospheric pressure is generally in the range from 0 to 100° C.; preferably in the range from 0 to 78° C. and particularly preferably in the range from 25 to 78° C.

In the process of the invention, the pH of the reaction medium is set so that it is favorable for the synthesis or the stability or preferably for both the synthesis and the stability of the framework. For example, the pH can be set via the at least one electrolyte salt.

If the reaction is carried out as a batch reaction, the reaction time is generally in the range up to 30 hours, preferably in the range up to 20 hours, more preferably in the range from 1 to 10 hours and particularly preferably in the range from 1 to 5 hours.

Particular preference is given to the ratio of the reaction time for step (b) to that for step (a) being at least 1:1. The ratio is more preferably at least 2:1, even more preferably at least 5:1 and in particular at least 10:1.

The first organic compound is a monocyclic, bicyclic or polycyclic saturated or unsaturated hydrocarbon in which at least two ring carbons have been replaced by heteroatoms selected from the group consisting of N, O and S.

The first organic compound preferably comprises at least nitrogen as ring atom; more preferably, exclusively nitrogen occurs as heteroatom.

The hydrocarbon can be unsubstituted or substituted. If more than one substituent is present, the substituents can be identical or different. Substituents can be, independently of one another, phenyl, amino, hydroxy, thio, halogen, pseudohalogen, formyl, amide, an acyl having an aliphatic saturated or unsaturated hydrocarbon radical having from 1 to 4 carbon atoms and an aliphatic branched or unbranched saturated or unsaturated hydrocarbon having from 1 to 4 carbon atoms. If the substituents comprise one or more hydrogen atoms, each of these can independently also be replaced by an aliphatic branched or unbranched saturated or unsaturated hydrocarbon having from 1 to 4 carbon atoms.

Halogen can be fluorine, chlorine, bromine or iodine. Pseudohalogen is, for example, cyano, cyanato or isocyanato.

An aliphatic branched or unbranched saturated or unsaturated hydrocarbon having from 1 to 4 carbon atoms is, for example, methyl, ethyl, n-propyl, i-propyl, n-butyl, i-butyl, t-butyl, vinyl, ethynyl or allyl.

An acyl having an aliphatic saturated or unsaturated hydrocarbon radical having from 1 to 4 carbon atoms is, for example, acetyl or ethylcarbonyl.

The first organic compound is preferably unsubstituted or bears one substituent which is methyl or ethyl.

The monocyclic, bicyclic or polycyclic hydrocarbon preferably has 5- or 6-membered rings, more preferably 6-membered rings.

It is also preferred that the at least two heteroatoms are each nitrogen.

The first organic compound more preferably has precisely two heteroatoms, preferably nitrogen.

When the hydrocarbon has a 6-membered ring in which two heteroatoms, preferably nitrogen, are present, these are preferably in the para positions relative to one another.

It is also preferred that the first organic compound can be derived from an unsaturated hydrocarbon which is aromatic or fully saturated. If the first organic compound has more than one ring, preference is given to at least one ring being aromatic.

The monocyclic hydrocarbon from which the first organic compound is derived is, for example, cyclobutane, cyclobutene, cyclobutadiene, cyclopentane, cyclopentene, cyclopentadiene, benzene, cyclohexane or cyclohexene. The monocyclic hydrocarbon from which the second organic compound is derived is preferably benzene or cyclohexane.

The bicyclic hydrocarbon from which the first organic compound is derived can, for example, comprise two rings which are linked to one another via a covalent single bond or via a group R.

R can be —O—, —NH—, —S—, —OC(O)—, —NHC(O)—, —N═N—, or an aliphatic branched or unbranched saturated or unsaturated hydrocarbon which has from 1 to 4 carbon atoms and may be interrupted by an atom or functional group or by a plurality of independent atoms or functional groups selected from the group consisting of —O—, —NH—, —S—, —OC(O)—, —NHC(O)— and —N═N—.

Examples of a bicyclic hydrocarbon from which the first organic compound is derived and which comprises two rings linked to one another via a covalent single bond or via a group R are biphenyl, stilbene, biphenyl ether, N-phenylbenzamide and azobenzene. Preference is given to biphenyl.

The bicyclic hydrocarbon from which the first compound is derived can also be a fused ring system.

Examples are decalin, tetralin, naphthalene, indene, indane, pentalene. Preference is given to tetralin and naphthalene.

The bicyclic hydrocarbon from which the first organic compound is derived can also have a bridged ring system.

Examples are bicyclo[2.2.1]heptane and bicyclo[2.2.2]octane, with the latter being preferred.

The polycyclic hydrocarbon from which the first organic compound is derived can likewise comprise fused and/or bridged ring systems.

Examples are biphenylene, indacene, fluorene, phenalene, phenanthrene, anthracene, naphthacene, pyrene, chrysene, triphenylene, 1,4-dihydro-1,4-ethanonaphthalene and 9,10-dihydro-9,10-ethanoanthracene. Preference is given to pyrene, 1,4-dihydro-1,4-ethanonaphthalene and 9,10-dihydro-9,10-ethanoanthracene.

If the first organic compound has more than one ring, the at least two heteroatoms can be present in one ring or in a plurality of rings.

The first organic compound is particularly preferably selected from the group consisting of

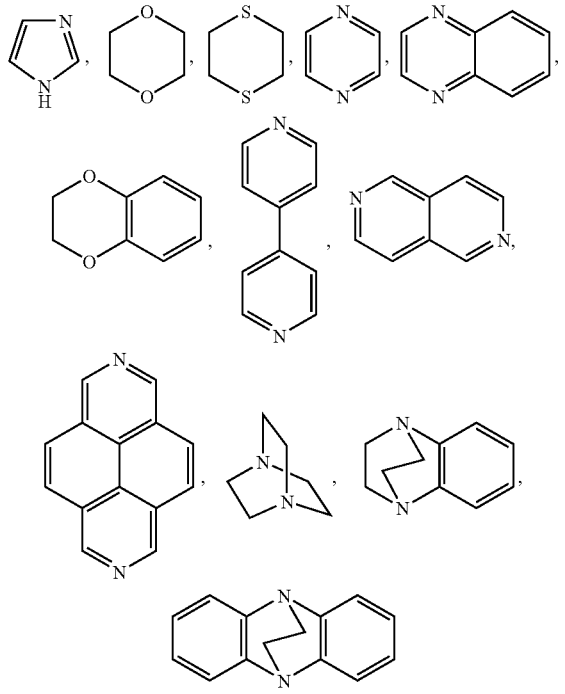

and substituted derivatives thereof.

Suitable substituents are the substituents mentioned in general terms above for the first organic compound. Particularly preferred substituents are methyl and ethyl. In particular, the substituted derivatives preferably have only one substituent. Very particularly preferred substituted derivatives are 2-methylimidazole and 2-ethylimidazole.

The second organic compound is derived from a dicarboxylic, tricarboxylic and tetracarboxylic acid.

Further at least bidentate organic compounds can participate in the formation of the framework and be used in step (b) of the process of the invention. However, it is likewise possible for organic compounds which are not at least bidentate to be additionally comprised in the framework. These can be derived, for example, from a monocarboxylic acid and be present both in step (a) and in step (b) of the process of the invention.

For the purposes of the present invention, the term "derived" means that the dicarboxylic, tricarboxylic or tetracarboxylic acid can be present in partially deprotonated or fully deprotonated form in the framework. Furthermore, the dicarboxylic, tricarboxylic or tetracarboxylic acid can comprise a substituent or a plurality of independent substituents. Examples of such substituents are —OH, —$NH_2$, —$OCH_3$, —$CH_3$, —$NH(CH_3)$, —$N(CH_3)_2$, —CN and halides. Furthermore, the term "derived" means, in the context of the present invention, that the dicarboxylic, tricarboxylic or tetracarboxylic acid can also be present in the form of the corresponding sulfur analogues. Sulfur analogues are the functional groups —C(═O)SH and its tautomer and C(═S)SH, which can be used in place of one or more carboxylic acid groups. Furthermore, the term "derived" means, in the context of the present invention, that one or more carboxylic acid functions can be replaced by a sulfonic acid group (—$SO_3H$). Furthermore, a sulfonic acid group can likewise occur in addition to the 2, 3 or 4 carboxylic acid functions.

The dicarboxylic, tricarboxylic or tetracarboxylic acid has, apart from the abovementioned functional groups, an organic skeleton or an organic compound to which these are bound. Here, the abovementioned functional groups can in principle be bound to any suitable organic compound as long as it is ensured that the organic compound bearing these functional groups is capable of forming the coordinate bond to produce the framework.

The second organic compound is preferably derived from a saturated or unsaturated aliphatic compound or an aromatic compound or a both aliphatic and aromatic compound.

The aliphatic compound or the aliphatic part of the both aliphatic and aromatic compound can be linear and/or branched and/or cyclic, with a plurality of rings per compound also being possible. More preferably, the aliphatic compound or the aliphatic part of the both aliphatic and aromatic compound comprises from 1 to 18, more preferably from 1 to 14, more preferably from 1 to 13, more preferably from 1 to 12, more preferably from 1 to 11 and particularly preferably from 1 to 10, carbon atoms, for example, 1, 2, 3, 4, 5, 6, 7, 8, 9 or 10 carbon atoms. Particular preference is given here to, inter alia, methane, adamantane, acetylene, ethylene or butadiene.

The aromatic compound or the aromatic part of the both aromatic and aliphatic compound can have one or more rings, for example two, three, four or five rings, in which case the rings may be present separately from one another and/or at least two rings may be present in fused form. The aromatic compound or the aromatic part of the both aliphatic and aromatic compound more preferably has one, two or three rings, with one or two rings being particularly preferred. Furthermore, each ring of the compound mentioned can independently comprise at least one heteroatom such as N, O, S, B, P, Si, preferably N, O and/or S. More preferably, the aromatic compound or the aromatic part of the both aromatic and aliphatic compound comprises one or two $C_6$ rings, with the two being able to be present separately from one another or in fused form. In particular, mention may be made of benzene, naphthalene and/or biphenyl and/or bipyridyl and/or pyridine as aromatic compounds.

The second organic compound is more preferably an aliphatic or aromatic, acyclic or cyclic hydrocarbon which has from 1 to 18, preferably from 1 to 10 and in particular 6, carbon atoms and additionally has exclusively 2, 3 or 4 carboxyl groups as functional groups.

The second organic compound can, for example, be derived from a dicarboxylic acid such as oxalic acid, succinic acid, tartaric acid, 1,4-butanedicarboxylic acid, 1,4-butenedicarboxylic acid, 4-oxopyran-2,6-dicarboxylic acid, 1,6-hexanedicarboxylic acid, decanedicarboxylic acid, 1,8-heptadecanedicarboxylic acid, 1,9-heptadecane-dicarboxylic acid, heptadecanedicarboxylic acid, acetylenedicarboxylic acid, 1,2-benzenedicarboxylic acid, 1,3-benzenedicarboxylic acid, 2,3-pyridinedicarboxylic acid, pyridine-2,3-dicarboxylic acid, 1,3-butadiene-1,4-dicarboxylic acid, 1,4-benzenedicarboxylic acid, p-benzenedicarboxylic acid, imidazole-2,4-dicarboxylic acid, 2-methylquinoline-3,4-dicarboxylic acid; quinoline-2,4-dicarboxylic acid, quinoxaline-2,3-dicarboxylic acid, 6-chloroquinoxaline-2,3-dicarboxylic acid, 4,4'-diaminophenyl-methane-3,3'-dicarboxylic acid, quinoline-3,4-dicarboxylic acid, 7-chloro-4-hydroxyquinoline-2,8-dicarboxylic acid, diimidedicarboxylic acid, pyridine-2,6-dicarboxylic acid, 2-methylimidazole-4,5-dicarboxylic acid, thiophene-3,4-dicarboxylic acid, 2-isopropylimidazole-4,5-dicarboxylic acid, tetrahydropyran-4,4-dicarboxylic acid, perylene-3,9-dicarboxylic acid, perylenedicarboxylic acid, Pluriol E 200-dicarboxylic acid, 3,6-dioxaoctanedicarboxylic acid, 3,5-cyclohexadiene-1,2-dicarboxylic acid, octanedicarboxylic acid, pentane-3,3-dicarboxylic acid, 4,4'-diamino-1,1'-diphenyl-3,3'-dicarboxylic acid, 4,4'-diaminodiphenyl-3,3'-dicarboxylic acid, benzidine-3,3'-dicarboxylic acid, 1,4-bis(phenylamino)benzene-2,5-dicarboxylic acid, 1,1'-binaphthyldicarboxylic acid, 7-chloro-8-methylquinoline-2,3-dicarboxylic acid, 1-anilinoanthraquinone-2,4'-dicarboxylic acid, polytetrahydrofuran-250-dicarboxylic acid, 1,4-bis(carboxymethyl)piperazine-2,3-dicarboxylic acid, 7-chloroquinoline-3,8-dicarboxylic acid, 1-(4-carboxy)phenyl-3-(4-chloro) phenylpyrazoline-4,5-dicarboxylic acid, 1,4,5,6,7,7-hexachloro-5-norbornene-2,3-dicarboxylic acid, phenylindanedicarboxylic acid, 1,3-dibenzyl-2-oxoimidazolidine-4,5-dicarboxylic acid, 1,4-cyclohexanedicarboxylic acid, naphthalene-1,8-dicarboxylic acid, 2-benzoylbenzene-1,3-dicarboxylic acid, 1,3-dibenzyl-2-oxoimidazolidine-4,5-cis-dicarboxylic acid, 2,2'-biquinoline-4,4'-dicarboxylic acid, pyridine-3,4-dicarboxylic acid, 3,6,9-trioxaundecanedicarboxylic acid, hydroxybenzophenonedicarboxylic acid, Pluriol E 300-dicarboxylic acid, Pluriol E 400-dicarboxylic acid, Pluriol E 600-dicarboxylic acid, pyrazole-3,4-dicarboxylic acid, 2,3-pyrazinedicarboxylic acid, 5,6-dimethyl-2,3-pyrazinedicarboxylic acid, 4,4'-diamino(diphenyl ether)diimidodicarboxylic acid, 4,4'-diaminodiphenylmethanediimidodicarboxylic acid, 4,4'-diamino(diphenyl sulfone)-diimidodicarboxylic acid, 1,4-naphthalenedicarboxylic acid, 2,6-naphthalenedicarboxylic acid, 1,3-adamantanedicarboxylic acid, 1,8-naphthalenedicarboxylic acid, 2,3-naphthalenedicarboxylic acid, 8-methoxy-2,3-naphthalenedicarboxylic acid, 8-nitro-2,3-naphthalenedicarboxylic acid, 8-sulfo-2,3-naphthalenedicarboxylic acid, anthracene-2,3-dicarboxylic acid, 2',3'-diphenyl-p-terphenyl-4,4"-dicarboxylic acid, (diphenyl ether)-4,4'-dicarboxylic acid, imidazole-4,5-dicarboxylic acid, 4(1H)-oxo-thiochromene-2,8-dicarboxylic acid, 5-tert-butyl-1,3-benzenedicarboxylic acid, 7,8-quinolinedicarboxylic acid, 4,5-imidazoledicarboxylic acid, 4-cyclohexene-1,2-dicarboxylic acid, hexatriacontanedicarboxylic acid, tetradecanedicarboxylic acid, 1,7-heptanedicarboxylic acid, 5-hydroxy-1,3-benzenedicarboxylic acid, 2,5-dihydroxy-1,4-dicarboxylic acid, pyrazine-2,3-dicarboxylic acid, furan-2,5-dicarboxylic acid, 1-nonene-6,9-dicarboxylic acid, eicosenedicarboxylic acid, 4,4'-dihydroxy-diphenylmethane-3,3'-dicarboxylic acid, 1-amino-4-methyl-9,10-dioxo-9,10-dihydro-anthracene-2,3-dicarboxylic acid, 2,5-pyridinedicarboxylic acid, cyclohexene-2,3-dicarboxylic acid, 2,9-dichlorofluorubin-4,11-dicarboxylic acid, 7-chloro-3-methyl-quinoline-6,8-dicarboxylic acid, 2,4-dichlorobenzophenone-2',5'-dicarboxylic acid, 1,3-benzenedicarboxylic acid, 2,6-pyridinedicarboxylic acid, 1-methylpyrrole-3,4-dicarboxylic acid, 1-benzyl-1H-pyrrole-3,4-dicarboxylic acid, anthraquinone-1,5-dicarboxylic acid, 3,5-pyrazoledicarboxylic acid, 2-nitrobenzene-1,4-dicarboxylic acid, heptane-1,7-dicarboxylic acid, cyclobutane-1,1-dicarboxylic acid 1,14-tetradecanedicarboxylic acid, 5,6-dehydronorbornane-2,3-dicarboxylic acid, 5-ethyl-2,3-pyridinedicarboxylic acid or camphordicarboxylic acid.

Furthermore, the second organic compound is more preferably one of the dicarboxylic acids mentioned by way of example above as such.

The second organic compound can, for example be derived from a tricarboxylic acid such as 2-hydroxy-1,2,3-propanetricarboxylic acid, 7-chloro-2,3,8-quinolinetricarboxylic acid, 1,2,3-, 1,2,4-benzenetricarboxylic acid, 1,2,4-butanetricarboxylic acid, 2-phosphono-1,2,4-butanetricarboxylic acid, 1,3,5-benzenetricarboxylic acid, 1-hydroxy-1,2,3-propanetricarboxylic acid, 4,5-dihydro-4,5-dioxo-1H-pyrrolo[2,3-F]quinoline-2,7,9-tricarboxylic acid, 5-acetyl-3-amino-6-methylbenzene-1,2,4-tricarboxylic acid, 3-amino-5-benzoyl-6-methylbenzene-1,2,4-tricarboxylic acid, 1,2,3-propanetricarboxylic acid or aurintricarboxylic acid.

Furthermore, the second organic compound is more preferably one of the tricarboxylic acids mentioned by way of example above as such.

A second organic compound can, for example, be derived from a tetracarboxylic acid such as 1,1-dioxidoperylo[1,12-BCD]thiophene-3,4,9,10-tetracarboxylic acid, perylenetetra-carboxylic acids such as perylene-3,4,9,10-tetracarboxylic acid or perylene-1,12-sulfone-3,4,9,10-tetracarboxylic acid, butanetetracarboxylic acids such as 1,2,3,4-butanetetracarboxylic acid or meso-1,2,3,4-butanetetracarboxylic acid, decane-2,4,6,8-tetracarboxylic acid, 1,4,7,10,13,16-hexaoxacyclooctadecane-2,3,11,12-tetra-carboxylic acid, 1,2,4,5-benzenetetracarboxylic acid, 1,2,11,12-dodecanetetra-carboxylic acid, 1,2,5,6-hexanetetracarboxylic acid, 1,2,7,8-octane-tetracarboxylic acid, 1,4,5,8-naphthalenetetracarboxylic acid, 1,2,9,10-decanetetracarboxylic acid, benzophenonetetracarboxylic acid, 3,3',4,4'-benzophenonetetracarboxylic acid, tetrahydrofurantetracarboxylic acid or cyclopentanetetracarboxylic acids such as cyclopentane-1,2,3,4-tetracarboxylic acid.

Furthermore, the second organic compound is more preferably one of the tetracarboxylic acids mentioned by way of example above as such.

Very particular preference is given to using optionally at least monosubstituted aromatic dicarboxylic, tricarboxylic or tetracarboxylic acids having one, two, three, four or more rings, with each of the rings being able to comprise at least one heteroatom and two or more rings being able to comprise identical or different heteroatoms. Examples of preferred carboxylic acids of this type are one-ring dicarboxylic acids, one-ring tricarboxylic acids, one-ring tetracarboxylic acids, two-ring dicarboxylic acids, two-ring tricarboxylic acids, two-ring tetracarboxylic acids, three-ring dicarboxylic acids, three-ring tricarboxylic acids, three-ring tetracarboxylic acids, four-ring dicarboxylic acids, four-ring tricarboxylic acids and/or four-ring tetracarboxylic acids. Suitable heteroatoms are, for example, N, O, S, B, P and preferred heteroatoms are N, S and/or O, Suitable substituents are, inter alia, —OH, a nitro group, an amino group or an alkyl or alkoxy group.

As at least bidentate organic compounds, particular preference is given to using acetylenedicarboxylic acid (ADC), camphordicarboxylic acid, fumaric acid, succinic acid, benzenedicarboxylic acids, naphthalenedicarboxylic acids, biphenyldicarboxylic acids such as 4,4'-biphenyldicarboxylic acid (BPDC), pyrazinedicarboxylic acids, such as 2,5-pyrazinedicarboxylic acid, bipyridinedicarboxylic acids such as 2,2'-bipyridine-dicarboxylic acids, e.g. 2,2'-bipyridine-5,5'-dicarboxylic acid, benzenetricarboxylic acids such as 1,2,3-, 1,2,4-benzenetricarboxylic acid or 1,3,5-benzenetricarboxylic acid (BTC), benzenetetracarboxylic acid, adamantanetetracarboxylic acid (ATC), adamantanedibenzoate (ADB), benzenetribenzoate (BTB), methanetetrabenzoate (MTB), adamantanetetrabenzoate or dihydroxyterephthalic acids such as 2,5-dihydroxyterephthalic acid (DHBDC).

Very particular preference is given to, inter alia, phthalic acid, isophthalic acid, terephthalic acid, 2-aminoterephthalic acid, 5-aminoisophthalic acid, 4,4'-biphenyl-dicarboxylic acid, 1,4-cyclohexanedicarboxylic acid, (+)-camphoric acid, succinic acid, 1,4-naphthalenedicarboxylic acid, 1,5-naphthalenedicarboxylic acid, 2,6-naphthalene-dicarboxylic acid, 1,2,3-benzenetricarboxylic acid, 1,2,4-benzenetricarboxylic acid, 1,3,5-benzenetricarboxylic acid, 1,2,3,4-benzenetetracarboxylic acid or 1,2,4,5-benzenetetracarboxylic acid.

Apart from these at least bidentate organic compounds, the metal organic framework can further comprise one or more monodentate ligands and/or one or more at least bidentate ligands which are not derived from a dicarboxylic, tricarboxylic or tetra-carboxylic acid.

The at least one at least bidentate organic compound preferably comprises no hydroxy or phosphonic acid groups.

As indicated above, one or more carboxylic acid functions can be replaced by a sulfonic acid function. Furthermore, a sulfonic acid group can also be additionally present. Finally, it is likewise possible for all carboxylic acid functions to be replaced by a sulfonic acid function.

Such sulfonic acids or their salts which are commercially available are, for example 4-amino-5-hydroxynaphthalene-2,7-disulfonic acid, 1-amino-8-naphthol-3,6-disulfonic acid, 2-hydroxynaphthalene-3,6-disulfonic acid, benzene-1,3-disulfonic acid, 1,8-dihydroxynaphthalene-3,6-disulfonic acid, 1,2-dihydroxybenzene-3,5-disulfonic acid, 4,5-dihydroxynaphthalene-2,7-disulfonic acid, 2,9-dimethyl-4,7-diphenyl-1,10-phenanthrolinedisulfonic acid, 4,7-diphenyl-1,10-phenanthrolinedisulfonic acid, ethane-1,2-disulfonic acid, naphthalene-1,5-disulfonic acid, 2-(4-nitrophenylazo)-1,8-dihydroxynaphthalene-3,6-disulfonic acid, 2,2'-dihydroxy-1,1'-azonaphthalene-3',4,6'-trisulfonic acid.

The first organic compound is used in a concentration which is generally in the range from 0.1 to 30% by weight, preferably in the range from 0.5 to 20% by weight and particularly preferably in the range from 2 to 10% by weight, in each case based on the total weight of the reaction system minus the weight of the anode and the cathode. Accordingly, the term "concentration" in this case comprises both the amount of the first organic compound dissolved in the reaction system and, for example, any amount of this suspended in the reaction system.

In a preferred embodiment of the process of the invention, the first organic compound is added continuously and/or discontinuously as a function of the progress of the electrolysis and, in particular, as a function of the decomposition of the anode or liberation of the at least one metal ion and/or as a function of the formation of the reaction intermediate.

In a very particularly preferred embodiment of step a) of the process of the invention, the reaction medium comprises at least one suitable electrolyte salt. Depending on the first organic compound used and/or any solvent used, it is also possible to carry out the preparation of the reaction intermediate without additional electrolyte salt in the process of the invention.

The electrolyte salts which can be used in step a) of the process of the invention are subject to essentially no restrictions. Preference is given to using, for example, salts of mineral acids, sulfonic acids, phosphonic acids, boronic acids, alkoxysulfonic acids or carboxylic acids or of other acidic compounds such as sulfonamides or imides.

Accordingly, possible anionic components of the at least one electrolyte are, inter alia, sulfate, nitrate, nitrite, sulfite, disulfite, phosphate, hydrogenphosphate, dihydrogenphosphate, diphosphate, triphosphate, phosphite, chloride, chlorate, bromide, bromate, iodide, iodate, carbonate or hydrogencarbonate.

As cationic component of the electrolyte salts which can be used according to the invention, mention may be made of, inter alia, alkali metal ions such as $Li^+$, $Na^+$, $K^+$ or $Rb^+$, alkaline earth metal ions such as $Mg^{2+}$, $Ca^{2+}$, $Sr^{2+}$ or $Ba^{2+}$, ammonium ions or phosphonium ions.

As ammonium ions, mention may be made of quaternary ammonium ions and protonated monoamines, diamines and triamines.

Examples of quaternary ammonium ions which are preferably used according to the invention in step a) of the process of the invention are, inter alia,

- symmetrical ammonium ions such as tetraalkylammonium which preferably bears $C_1$-$C_4$-alkyl groups, for example methyl, ethyl, n-propyl, isopropyl, n-butyl, isobutyl, tert-butyl, e.g. tetramethylammonium, tetraethylammonium, tetrapropylammonium, tetrabutylammonium, or
- unsymmetrical ammonium ions such as unsymmetrical tetraalkylammonium which preferably bears $C_1$-$C_4$-alkyl groups, for example methyl, ethyl, n-propyl, isopropyl, n-butyl, isobutyl, tert-butyl, e.g. methyltributylammonium, or
- ammonium ions bearing at least one aryl group such as phenyl or napthyl or at least one alkaryl group such as benzyl or at least one aralkyl group and at least one alkyl group, preferably $C_1$-$C_4$-alkyl, for example methyl, ethyl, n-propyl, isopropyl, n-butyl, isobutyl, tert-butyl, e.g. aryltrialkylammonium such as benzyltrimethylammonium or benzyltriethylammonium.

In a particularly preferred embodiment, at least one electrolyte salt which comprises a methyltributylammonium ion as at least one cationic component is used in step a) of the process of the invention.

In a particularly preferred embodiment, methyltributylammonium methylsulfate is used as electrolyte salt in step a) of the process of the invention.

Ionic liquids such as methylethylimidazolium chloride or methylbutylimidazolium chloride can also be used as electrolyte salts in the process of the invention.

In a likewise preferred embodiment, methanesulfonate is used as electrolyte salt in the process of the invention.

For the purposes of the invention, mention may also be made of protonated or quaternary heterocycles such as the imidazolium ion as cationic component of the at least one electrolyte salt.

In an embodiment of the process of the invention which is preferred inter alia, it is possible to introduce compounds used for the formation of the reaction intermediate into the reaction medium via the cationic and/or anionic component of the at least one electrolyte salt. These compounds are compounds which influence the structure of the reaction intermediate but are not comprised in the resulting intermediate and also ones which are comprised in the resulting intermediate. In particular, at least one compound which is comprised in the resulting reaction intermediate can be introduced via at least one electrolyte salt in the process of the invention.

In an embodiment of the process of the invention, it is thus possible for the metal ion to be introduced into the reaction medium via the cationic component of the at least one electrolyte salt in addition to the at least one anode as metal ion source in step a). It is likewise possible for at least one metal ion which is different from the at least one metal ion introduced by means of anodic oxidation to be introduced into the reaction medium via the cationic component of the at least one electrolyte salt, with this difference being able to be based on the valence of the cation and/or the type of metal.

The present invention therefore also describes a process as described above in which the at least one electrolyte salt comprises a salt of the first organic compound.

The concentration of the at least one electrolyte salt in the process of the invention is generally in the range from 0.01 to 10% by weight, preferably in the range from 0.05 to 5% by weight and particularly preferably in the range from 0.1 to 3% by weight, in each case based on the sum of the weights of all electrolyte salts present in the reaction system and further based on the total weight of the reaction system without taking the anodes and cathodes into account.

If step a) of the process is carried out in the batch mode, the reaction medium comprising the starting materials is generally firstly provided, electric current is subsequently applied and the reaction medium is then circulated by pumping.

If the process is carried out continuously, a substream is generally taken off from the reaction medium, the reaction intermediate comprised therein is isolated and the mother liquor is recirculated.

In a particularly preferred embodiment, step a) of the process of the invention is carried out so that redeposition of the metal ion liberated by anodic oxidation on the cathode is prevented.

According to the invention, this redeposition is preferably prevented by, for example, using a cathode which has a suitable hydrogen overvoltage in a given reaction medium. Such cathodes are, for example, the abovementioned graphite, copper, zinc, tin, manganese, silver, gold, platinum cathodes or cathodes comprising alloys such as steels, bronzes or brass.

Furthermore, the redeposition is, according to the invention, preferably prevented by, for example, using an electrolyte which permits the cathodic formation of hydrogen in the reaction medium. For this purpose, preference is given to, inter alia, an electrolyte which comprises at least one protic solvent. Preferred examples of such solvents have been given above. Particular preference is given here to alcohols, in particular methanol and ethanol.

Furthermore, the redeposition is, according to the invention, preferably prevented by, for example, at least one compound which leads to cathodic depolarization being comprised in the reaction medium. For the purposes of the present invention, a compound which leads to cathodic depolarization is any compound which is reduced at the cathode under the given reaction conditions.

As cathodic depolarizers, preference is given to, inter alia, compounds which are hydrodimerized at the cathode. In this context, particular preference is given to, for example, acrylonitrile, acrylic esters and maleic esters, for example the further preferred dimethyl maleate.

Further preferred cathodic depolarizers are, inter alia, compounds which comprise at least one carbonyl group which is reduced at the cathode. Examples of such compounds comprising carbonyl groups are ketones, for example acetone.

As cathodic depolarizers, preference is given to, inter alia, compounds which have at least one nitrogen-oxygen bond, nitrogen-nitrogen bond and/or nitrogen-carbon bond and are reduced at the cathode. Examples of such compounds are compounds having a nitro group, compounds having an azo group, compounds having an azoxy group, oximes, pyridines, imines, nitrites and/or cyanates.

In the process of the invention, it is also possible to combine at least two of the abovementioned measures for preventing cathodic redeposition. For example, it is possible both to use an electrolyte which promotes cathodic formation of hydrogen and also to use an electrode having a suitable hydrogen overvoltage. It is likewise possible both to use an electrolyte which promotes cathodic formation of hydrogen and to add at least one compound which leads to cathodic depolarization. It is likewise possible both to add at least one compound which leads to cathodic depolarization and to use a cathode having a suitable hydrogen overvoltage. Furthermore, it is possible to use an electrolyte which promotes cathodic formation of hydrogen and also to use an electrode having a suitable hydrogen overvoltage and also to add at least one compound which leads to cathodic depolarization.

The present invention therefore also provides a process as described above in which cathodic redeposition of the at least one metal ion is at least partly prevented in step a) by means of at least one of the following measures:

(i) use of an electrolyte which promotes cathodic formation of hydrogen;

(ii) addition of at least one compound which leads to cathodic depolarization;

(iii) use of a cathode having a suitable hydrogen overvoltage.

The present invention therefore likewise provides a process as described above in which the electrolyte used according to (i) comprises at least one protic solvent, in particular an alcohol, more preferably methanol and/or ethanol.

In a particularly preferred embodiment, step a) of the process of the invention is operated in the recycle mode. For the purposes of the present invention, this "electrolysis circuit" refers to any process in which at least part of the reaction system present in the electrolysis cell is discharged from the electrolysis cell, if appropriate subjected to at least one intermediate treatment step such as at least one thermal treatment or addition and/or removal of at least one component of the discharged stream and recirculated to the electrolysis cell. For the purposes of the present invention, such an electrolysis circuit is particularly preferably operated in combination with a stacked plate cell, a tube cell or a pencil sharpener cell.

In general, a reaction intermediate which comprises the at least one metal ion and the first organic compound is present after the preparation. In addition, solvents can also be present.

The reaction intermediate is typically present as a suspension. The reaction intermediate can be separated off from its mother liquor. This separation can in principle be carried out using all suitable methods. The intermediate is preferably separated off by solid-liquid separation, centrifugation, extraction, filtration, membrane filtration, crossflow filtration, diafiltration, ultrafiltration, flocculation using flocculants such as nonionic, cationic and/or anionic auxiliaries, pH shift by addition of additives such as salts, acids or bases, floatation, spray drying, spray granulation or evaporation of the mother liquor at elevated temperatures and/or under reduced pressure and concentration of the solid.

The separation can be followed by at least one additional washing step, at least one additional drying step and/or at least one additional calcination step. If at least one washing step follows in step a) in the process of the invention, washing is preferably carried out using at least one solvent used in the synthesis.

If at least one drying step follows in step a) in the process of the invention, if appropriate after at least one washing step, the solid framework is dried at temperatures of generally from 20 to 120° C., preferably in the range from 40 to 100° C. and particularly preferably in the range from 56 to 60° C.

Preference is likewise given to drying under reduced pressure, with the temperatures generally being able to be selected so that the at least one washing medium is at least partly, preferably essentially completely, removed from the crystalline porous metal organic framework and the framework structure is at the same time not destroyed.

The drying time is generally in the range from 0.1 to 15 hours, preferably in the range from 0.2 to 5 hours and particularly preferably in the range from 0.5 to 1 hour.

The optional at least one washing step and optional at least one drying step in step a) can be followed by at least one calcination step in which the temperatures are preferably selected so that the structure of the framework is not destroyed.

It is, for example, possible for at least one template compound which has, if appropriate, been used for the electrochemical preparation according to the invention of the framework to be removed at least partly, preferably essentially quantitatively, by, in particular washing and/or drying and/or calcination.

However, the reaction intermediate is preferably used without work-up in step (b).

In step b) of the process of the invention, the reaction intermediate which has not been isolated is, as indicated above, reacted with a second organic compound or the intermediate is separated off and preferably reacted with the second organic compound in a solvent. This reaction is typically carried out as in classical preparative processes for porous metal organic frameworks (i.e. not electrochemically).

The reaction in step (b) of the process of the invention for preparing a porous metal organic framework can accordingly be carried out in an aqueous medium. Here, hydrothermal conditions or solvothermal conditions in general can be used. For the purposes of the present invention, the term "thermal" refers to a preparative process in which the reaction to form the porous metal organic framework according to the invention is carried out in a pressure vessel which is closed during the reaction and elevated temperature is applied, so that pressure builds up within the reaction medium in the pressure vessel because of the vapor pressure of solvent present.

However, the reaction in step (b) is preferably not carried out in an aqueous medium and likewise not under solvothermal conditions.

The reaction in step (b) of the process of the invention is preferably carried out in the presence of a nonaqueous solvent.

The reaction in step (b) is preferably carried out at a pressure of not more than 2 bar (absolute). However, the pressure is preferably not more than 1230 mbar (absolute).

The reaction particularly preferably takes place at atmospheric pressure. However, slightly superatmospheric or subatmospheric pressures can occur here as a result of the apparatus. For this reason, the term "atmospheric pressure" as used in the context of the present invention includes the pressure range given by the actual ambient atmospheric pressure ±150 mbar.

The reaction can be carried out at room temperature. However, it is preferably carried out at temperatures above room temperature. The temperature is preferably more than 100° C.

Furthermore, the temperature is preferably not more than 180° C. and more preferably not more than 150° C. Suitable ranges for set temperatures are from 0° C. to 250° C., more preferably from 50° C. to 200° C., in particular from 100° C. to 150° C.

Step (b) of the process of the invention for preparing a porous metal organic framework is typically carried out in water as solvent with addition of a further base. This serves to ensure, in particular, that a polybasic carboxylic acid used as at least bidentate organic compound is readily soluble in water. The preferred use of the nonaqueous organic solvent makes it unnecessary to use such a base. Nevertheless, the solvent for the process of the invention can be selected so that this itself has a basic reaction, but this is not absolutely necessary for carrying out the process of the invention.

It is likewise possible to use a base. However, preference is given to using no additional base.

It is also advantageous for the reaction to be able to take place with stirring, which is also advantageous for a scale-up.

The nonaqueous organic solvent is preferably a $C_{1-6}$-alkanol, dimethyl sulfoxide (DMSO), N,N-dimethylformamide (DMF), N,N-diethylformamide (DEF), acetonitrile, toluene, dioxane, benzene, chlorobenzene, methyl ethyl ketone (MEK), pyridine, tetrahydrofuran (THF), ethyl acetate, optionally halogenated $C_{1-200}$-alkane, sulfolane, glycol, N-methylpyrrolidone (NMP), gamma-butyrolactone, alicyclic alcohols such as cyclohexanol, ketones such as acetone or acetylacetone, cyclic ketones such as cyclohexanone, sulfolene or a mixture thereof.

A $C_{1-6}$-alkanol is an alcohol having from 1 to 6 carbon atoms. Examples are methanol, ethanol, n-propanol, i-propanol, n-butanol, i-butanol, t-butanol, pentanol, hexanol and mixtures thereof.

An optionally halogenated $C_{1-200}$-alkane is an alkane having from 1 to 200 carbon atoms in which one or more up to all hydrogen atoms may be replaced by halogen, preferably chlorine or fluorine, in particular chlorine. Examples are chloroform, dichloromethane, tetrachloromethane, dichloroethane, hexane, heptane, octane and mixtures thereof.

Preferred solvents are DMF, DEF and NMP. Particular preference is given to DMF.

The term "nonaqueous" preferably refers to a solvent which has a maximum water content of 10% by weight, more preferably 5% by weight, even more preferably 1% by weight, still more preferably 0.1% by weight, particularly preferably 0.01% by weight, based on the total weight of the solvent.

The maximum water content during the reaction is preferably 10% by weight, more preferably 5% by weight and even more preferably 1% by weight.

The term "solvent" encompasses pure solvents and mixtures of various solvents.

If solvents are used, it is preferred that the same solvent is used for steps (a) and (b) of the process of the invention.

Furthermore, the process step of the reaction of the at least one metal compound with the at least one at least bidentate organic compound is preferably followed by a calcination step. The temperature set here is typically above 250° C., preferably from 300 to 400° C.

The calcination step can remove the at least bidentated organic compound present in the pores.

In addition or as an alternative thereto, the removal of the at least bidentate organic compound (ligand) from the pores of the porous metal organic framework can be effected by treatment of the framework formed with a nonaqueous solvent. Here, the ligand is removed in the manner of an "extraction process" and, if appropriate, replaced in the framework by a solvent molecule. This mild method is particularly useful when the ligand is a high-boiling compound.

The treatment is preferably carried out for at least 30 minutes and can typically be carried out for up to 2 days. This can occur at room temperature or elevated temperature. It is preferably carried out at elevated temperature, for example at least 40° C., preferably 60° C. Further preference is given to the extraction taking place at the boiling point of the solvent used (under reflux).

The treatment can be carried out in a simple vessel by slurrying and stirring the framework. It is also possible to use extraction apparatuses such as Soxhlet apparatuses, in particular industrial extraction apparatuses.

Suitable solvents are those mentioned above, i.e., for example, $C_{1-6}$-alkanol, dimethyl sulfoxide (DMSO), N,N-dimethylformamide (DMF), N,N-diethylformamide (DEF), acetonitrile, toluene, dioxane, benzene, chlorobenzene, methyl ethyl ketone (MEK), pyridine, tetrahydrofuran (THF), ethyl acetate, optionally halogenated $C_{1-200}$-alkane, sulfolane, glycol, N-methylpyrrolidone (NMP), gamma-butyrolactone, alicyclic alcohols such as cyclohexanol, ketones such as acetone or acetylacetone, cyclic ketones such as cyclohexanone or mixtures thereof.

Preference is given to methanol, ethanol, propanol, acetone, MEK and mixtures thereof.

A very particularly preferred extractant is methanol.

The solvent used for extraction can be identical to or different from that used for the reaction of the at least one metal compound with the at least one at least bidentate organic compound. In particular, it is not absolutely necessary but is preferred that the solvent used in the "extraction" is water-free.

EXAMPLES

Example 1

Preparation of a Cu-BDC-TEDA-MOF

In an electrolysis cell having a copper rod as anode (active electrode area=639 $m^2$) and a concentric steel tube surrounding it and having a gap of 2 mm between anode and cathode, an electrolyte comprising 1802.6 g of methanol, 30.2 g of TEDA (=triethylenediamine) and 17.2 g of methyltributylammonium methylsulfate (MTBS) is circulated by pumping (700 l/h) at 45° C. A current of 14.5 A is passed through the electrolyte at a voltage of 7-18 V for 1 hour, resulting in dissolution of 19 g of copper. The experiment is repeated and the two reaction product mixtures are combined. 3641.5 g of a TEDA-comprising Cu methoxide suspension are obtained. 309.2 g of the TEDA-comprising Cu methoxide suspension (1.04% of Cu) are placed in a glass flask and 4.15 g of terephthalic acid are added while stirring. The mixture is stirred under reflux for 24 hours. The turquoise product is filtered off and washed with 4×50 ml of methanol. The product is subsequently dried at 50° C. in a vacuum drying oven for 16 hours. 8.9 g of powder are obtained.

The product has an $N_2$ surface area (Langmuir) of 1892 $m^2/g$. On the basis of the diffraction pattern, the MOF can be identified as the $Cu_2$(terephthalate)$_2$(TEDA) structure.

Example 2

Preparation of a Cu-BPDC-TEDA-MOF

The synthesis of Example 1 is repeated using 6.1 g of 4,4'-biphenyldicarboxylic acid in place of the terephthalic acid. 10.9 g of a light-blue powder are obtained.

The product has an $N_2$ surface area (Langmuir) of 2631 $m^2/g$. On the basis of the diffraction pattern, the MOF can be identified as the $Cu_2$(biphenyldicarboxylate)$_2$(TEDA) structure.

Example 3

Preparation of a Cu-Aminoterephthalic Acid-TEDA-MOF

The synthesis of Example 1 is repeated using 4.5 g of aminoterephthalic acid in place of the terephthalic acid. 9.6 g of a powder are obtained.

The product has an $N_2$ surface area (Langmuir) of 1545 $m^2/g$.

Example 4

Preparation of a Cu-Butanetetracarboxylic Acid-TEDA-MOF

The synthesis of Example 1 is repeated using 2.9 g of 1,2,3,4-butanetetracarboxylic acid in place of the terephthalic acid. 7.5 g of a light-blue powder are obtained.

The product has an $N_2$ surface area (Langmuir) of 699 $m^2$ μg.

Example 5

Preparation of a Cu-5-aminoisophthalic acid-TEDA-MOF

In an electrolysis cell having a copper rod as anode (active electrode area=639 $m^2$) and a concentric steel tube surrounding it and having a gap of 2 mm between anode and cathode, an electrolyte comprising 1802.6 g of methanol, 30.2 g of TEDA (=triethylenediamine) and 17.2 g of methyltributylammonium methylsulfate (MTBS) is circulated by pumping (700 l/h) at 46° C. A current of 14.5 A is passed through the electrolyte at a voltage of 8.5-20.1 V for 1 hour, resulting in dissolution of 17.5 g of copper. The experiment is repeated and the two reaction product mixtures are combined. 3664.3 g of a TEDA-comprising Cu methoxide suspension are obtained. 328.1 g of the TEDA-comprising Cu methoxide suspension (0.96% of Cu) are placed in a glass flask and 4.53 g of 5-aminoisophthalic acid are added while stirring. The mixture is stirred overnight (about 16 hours) under reflux. The olive-colored product is filtered off and washed with 3×50 ml of methanol. The product is subsequently dried at 50° C. in a vacuum drying oven for 16 hours. 9.3 g of powder are obtained.

The product has an $N_2$ surface area (Langmuir) of 215 $m^2/g$.

Example 6

Preparation of a Cu-Succinic Acid-TEDA-MOF

The synthesis of Example 5 is repeated using 2.95 g of succinic acid in place of the aminoisophthalic acid. 7.6 g of a greenish blue powder are obtained.

The product has an $N_2$ surface area (Langmuir) of 479 $m^2/g$.

Example 7

Preparation of a Cu-Cyclohexanedicarboxylic Acid-TEDA-MOF

The synthesis of Example 5 is repeated using 4.4 g of cyclohexane-1,4-dicarboxylic acid in place of the aminoisophthalic acid. 9.3 g of a greenish blue are obtained.

The product has an $N_2$ surface area (Langmuir) of 780 $m^2/g$.

Example 8

Preparation of a Cu-Camphoric Acid-TEDA-MOF

In an electrolysis cell having a copper rod as anode (active electrode area=639 $m^2$) and a concentric steel tube surrounding it and having a gap of 2 mm between anode and cathode, an electrolyte comprising 1802.6 g of methanol, 30.2 g of TEDA (=triethylenediamine) and 17.2 g of methyltributylammonium methylsulfate (MTBS) is circulated by pumping (700 l/h) at 46° C. A current of 14.5 A is passed through the electrolyte at a voltage of 6.7-8.6 V for 1 hour, resulting in dissolution of 16.5 g of copper. The experiment is repeated and the two reaction product mixtures are combined. 3678.8 g of a TEDA-comprising Cu methoxide suspension are obtained.

357.2 g of the TEDA-comprising Cu methoxide suspension (0.90% of Cu) are placed in a glass flask and 5.00 g of (+)-camphoric acid are added while stirring. The mixture is stirred overnight (about 16 hours) under reflux. The bluish green product is filtered off and washed with 3×50 ml of methanol. The product is subsequently dried at 50° C. in a vacuum drying oven for 16 hours. 10.6 g of powder are obtained.

The product has an $N_2$ surface area (Langmuir) of 746 $m^2/g$.

Example 9

Preparation of a Cu-BPDC-imidazole-MOF

In an electrolysis cell having a copper rod as anode (active electrode area=639 $m^2$) and a concentric steel tube surrounding it and having a gap of 2 mm between anode and cathode, an electrolyte comprising 1814.3 g of methanol, 18.5 g of imidazole and 17.2 g of methyltributylammonium methylsulfate (MTBS) is circulated by pumping (700 l/h) at 44° C. A current of 14.5 A is passed through the electrolyte at a voltage of 6.8-6.5 V for 1 hour, resulting in dissolution of 26 g of copper. The experiment is repeated and the two reaction product mixtures are combined. 3662.8 g of a Cu methoxide suspension comprising Cu imidazolide are obtained.

226.4 g of the Cu imidazolide suspension (1.42% of Cu) are placed in a glass flask and 6.10 g of 4,4'-biphenyldicarboxylic acid are added while stirring. The mixture is stirred overnight (about 16 hours) under reflux. The light-blue product is filtered off and washed with 3×50 ml of methanol. The product is subsequently dried at 50° C. in a vacuum drying oven for 16 hours. 11.2 g of powder are obtained.

The product has an $N_2$ surface area (Langmuir) of 514 $m^2/g$.

The invention claimed is:

1. A process for preparing a porous metal organic framework comprising at least two organic compounds coordinated to at least one metal ion, which comprises the steps:

(a) oxidation of at least one anode comprising the metal corresponding to at least one metal ion in a reaction medium in the presence of at least one first organic compound which is an optionally substituted monocyclic, bicyclic or polycyclic saturated or unsaturated hydrocarbon in which at least two ring carbons have been replaced by heteroatoms selected from the group consisting of N, O and S to form a reaction intermediate comprising the at least one metal ion and the first organic compound; and (b) reaction of the reaction intermediate at a set temperature with at least one second organic compound which coordinates to the at least one metal ion, with the second organic compound being derived from a dicarboxylic, tricarboxylic or tetracarboxylic acid.

2. The processing according to claim 1, wherein the at least one metal ion is selected from the group of metals consisting of copper, iron, aluminum, zinc, magnesium, zirconium, titanium, vanadium, molybdenum, tungsten, indium, calcium, strontium, cobalt, nickel, platinum, rhodium, ruthenium, palladium, scandium, yttrium, a lanthanide, manganese and rhenium.

3. The process according to claim 1, wherein the first organic compound is selected from the group consisting of:

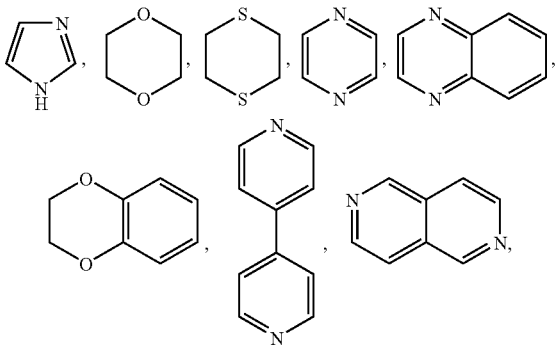

-continued

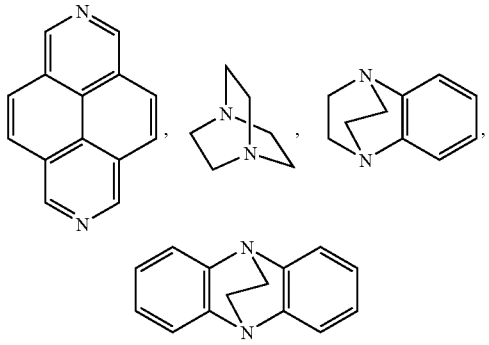

and substituted derivatives thereof.

4. The process according to claim 1, wherein the second organic compound is selected from the group consisting of phthalic acid, isophthalic acid, terephthalic acid, 2-aminoterephthalic acid, 5-aminoisophthalic acid, 4,4'-biphenyldicarboxylic aicd, 1,4-cyclohexanedicarboxylic acid, (+)-camphoric acid, succinic acid, 1,4-naphthalenedicarboxylic acid, 1,5-naphthalenedicarboxylic acid, 2,6-naphthalenedicarboxylic acid, 1,2,3-benzenetricarboxylic acid, 1,2,4-benzenetricarboxylic acid, 1,3,5-benzenetricarboxylic acid, 1,2,3,4-butanetetracarboxylic acid and 1,2,4,5-benzenetetracarboxylic acid.

5. The process according to claim 1, wherein the oxidation in step (a) is carried out in the presence of an organic solvent.

6. The process according to claim 5, wherein the organic solvent comprises an alcohol.

7. The process according to claim 1, wherein the reaction intermediate is present in a suspension.

8. The process according to claim 1, wherein the reaction intermediate is used without further work-up in step (b).

9. The process according to claim 1,wherein the set temperature in step (b) is in the range from 0° C. to 250° C.

10. The process according to claim 1, wherein the ratio of the reaction time for step (b) to that for step (a) is at least 1:1.

* * * * *